United States Patent [19]

Huggins

[11] Patent Number: 4,980,796

[45] Date of Patent: Dec. 25, 1990

[54] GAS IONIZATION SYSTEM AND METHOD

[75] Inventor: Richard A. Huggins, Cupertino, Calif.

[73] Assignee: Cybergen Systems, Inc., Campbell, Calif.

[21] Appl. No.: 272,396

[22] Filed: Nov. 17, 1988

[51] Int. Cl.[5] ..... B03C 3/00

[52] U.S. Cl. ..... 361/231; 55/123; 55/151; 55/152; 55/2

[58] Field of Search ..... 55/6, 2, 124–126, 55/138, 143, 145, 150–152, 123; 361/230–232

[56] References Cited

U.S. PATENT DOCUMENTS

| | | | |
|---|---|---|---|
| 1,428,839 | 9/1922 | Fortesque | 55/151 |
| 1,507,687 | 9/1924 | Schmidt | 55/2 |
| 1,980,521 | 11/1934 | Hahn | 361/230 |
| 2,343,338 | 3/1944 | Steel | 361/231 |
| 3,739,554 | 6/1973 | Whelten et al. | 55/138 |
| 3,910,778 | 10/1975 | Shahgholi | 55/136 |
| 4,133,652 | 1/1979 | Ishihawa et al. | 55/138 |
| 4,366,525 | 12/1982 | Baumgartner | 55/126 |
| 4,689,715 | 8/1987 | Halleck | 361/231 |
| 4,719,535 | 1/1988 | Zhenjun et al. | 361/232 |

FOREIGN PATENT DOCUMENTS

| | | | |
|---|---|---|---|
| 3331804 | 4/1985 | Fed. Rep. of Germany | 361/231 |
| 253256 | 9/1970 | U.S.S.R. | 55/151 |
| 931625 | 7/1963 | United Kingdom | 55/126 |

*Primary Examiner*—Bernard Nozick

*Attorney, Agent, or Firm*—Townsend and Townsend

[57] ABSTRACT

A gas ionization system for use in an enclosure having an inlet and an outlet. The system includes at least a pair of spaced electrodes, each electrode being formed of a wire screen, and the wire screens being parallel to each other. A stream of gas is passed through the enclosure and between and parallel to the wire screen electrodes. An electrical power source applies positive and negative voltages to the electrodes to generate an electric field between. The wire screen electrodes have discharge points for field emission of electrons. Free electrons are movable between the electrodes in a direction substantially perpendicular to the direction of travel of the gas stream. The intensity of the electric field is sufficiently large to cause substantially all free electrons in the electric field other than those electrons which ionize gas molecules to be retained in the space between the electrodes.

2 Claims, 3 Drawing Sheets

FIG 3
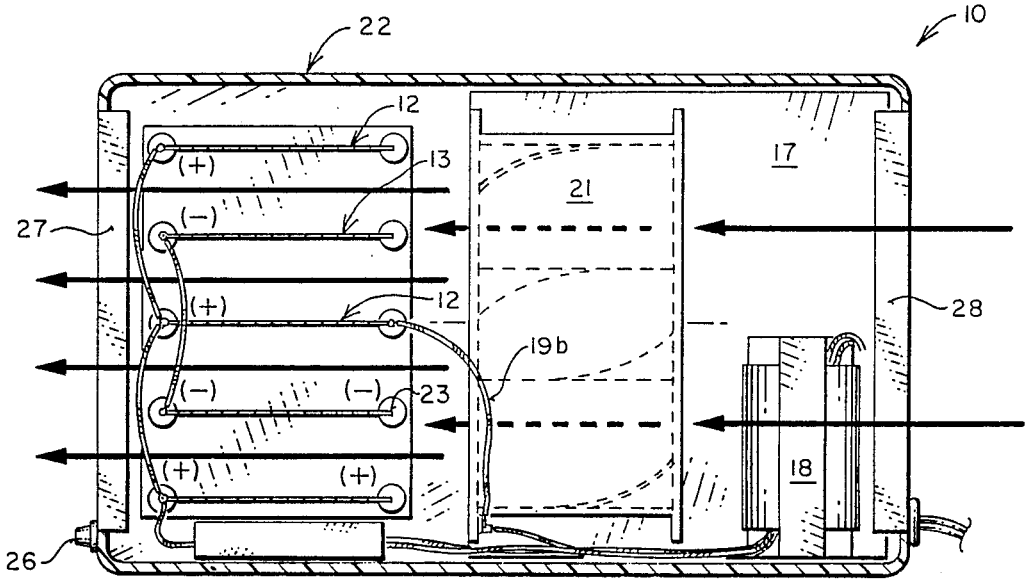
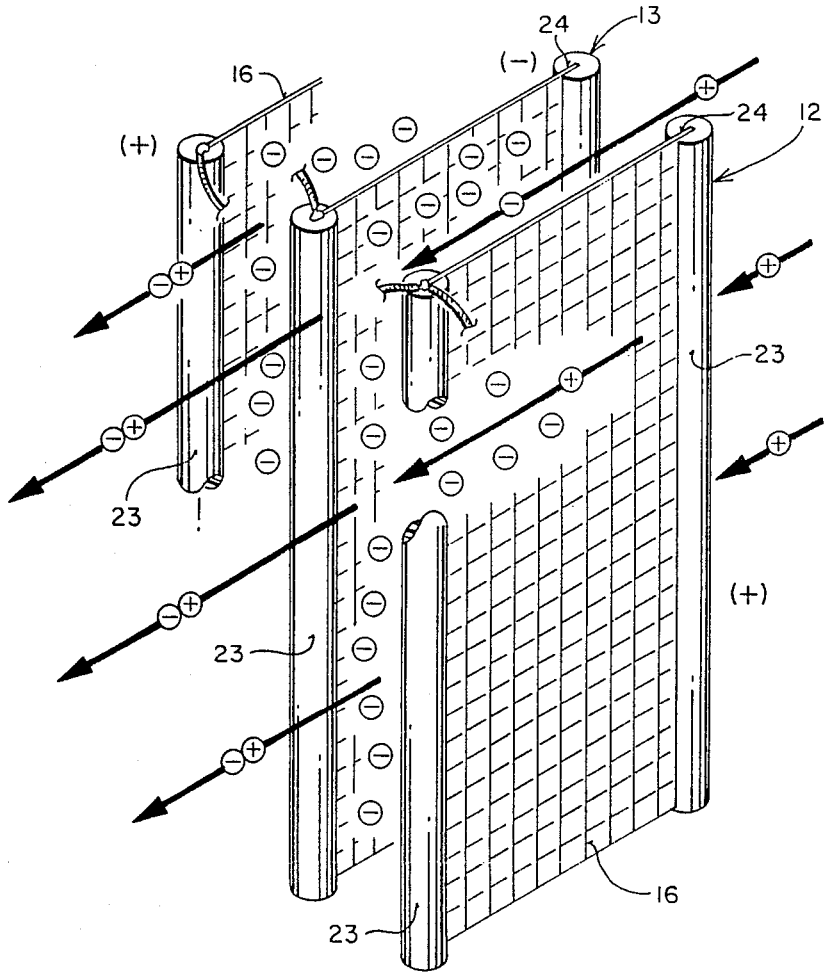
FIG 4

GAS IONIZATION SYSTEM AND METHOD

This invention pertains to a system and method for ionizing a gas (especially air) so as to maintain the walls of a room clean, and more particularly to such a system and method for ionization of gas to clean the environment by ionizing the particulate which then flows to the floor under gravitational and/or electrostatic forces.

The ionization of air is also considered useful for medical purposes, primarily with respect to relief of the respiratory tract in human beings, for example, with respect to relief from allergies and the like.

A major problem associated with this industry is that the ions are produced by high voltage needles in the range of 6 kilovolts and above. This produces high energy electrons that are then used to ionize the gas molecules in the air and thus produce the required negative ions. In some cases, the air cleaning could be handled by positive ions, but the medical aspect comes into play since positive ions have an undesired effect on humans to the extent that it seems to sap their energy, and positive ions are also more difficult to produce.

The aforesaid high voltage, high energy electrons produced by the high voltage needle style emitters have the effect of negatively charging the walls in their direct radiating path as well as (to a lesser extent) the walls of the room where they are installed. The negatively charged walls then collect dirt (which is normally more positively charged than the walls) and are known in the trade to "plate" the walls with particulates from the air. The walls can become black, dirty and unsightly, which is well known.

The present invention has to do with producing negative ions at low energy levels without the attendant high voltage, high energy electrons, which in turn does away with the normal "plating" of the walls and yet achieves the advantages of the aforementioned ion systems that it replaces.

SUMMARY OF THE INVENTION AND OBJECTS

In general, a gas ionization system is disclosed of a type serving to minimize accumulation of particulate on the interior of a room. The system includes means forming a dynamic population of electrons disposed to flow along a given axis between confronting spaced electrodes. The system further includes means forming a dynamic pneumatic flow of gas-borne molecules directed crosswise to the axis of and through said population of electrons to ionize molecules of the pneumatic flow. The electric field which produces the dynamic flow of electrons is sufficiently strong so that it retains all electrons in the electric field other than those electrons which ionize molecules of the pneumatic flow (and thereby leave with such molecules).

In the foregoing manner, free electrons are precluded from escaping the system to travel to the walls to provide a negative charge on the walls for attracting particulate thereto.

In general it is an object of the present invention to provide an improved gas ionization system and method.

It is yet another object of the invention to provide a gas ionization system and method wherein a dynamic population of electrons moves along one axis while a dynamic pneumatic flow of gas moves crosswise of the flow of the population of electrons so as to ionize molecules carried by the gas.

The flow of gas can be referred to as a field of molecules, just as the dynamic flow of electrons is referred to as a field of electrons.

It is yet another object of the present invention to provide an improved gas ionizing system wherein one of the fields moves transversely through the direction of movement of the other.

The foregoing and other objects of the invention will become more readily evident from the following detailed description of preferred embodiments when considered in conjunction with the drawings:

BRIEF DESCRIPTION OF THE DRAWINGS

FIG. 3 shows a top plan view of an ionizing unit according to FIG. 1 with portions removed for clarity;

FIG. 4 shows a diagrammatic view of confronting pervious grids employed in the unit shown in FIGS. 1, 2 and 3.

DETAILED DESCRIPTION OF PREFERRED EMBODIMENTS

Figure 1:
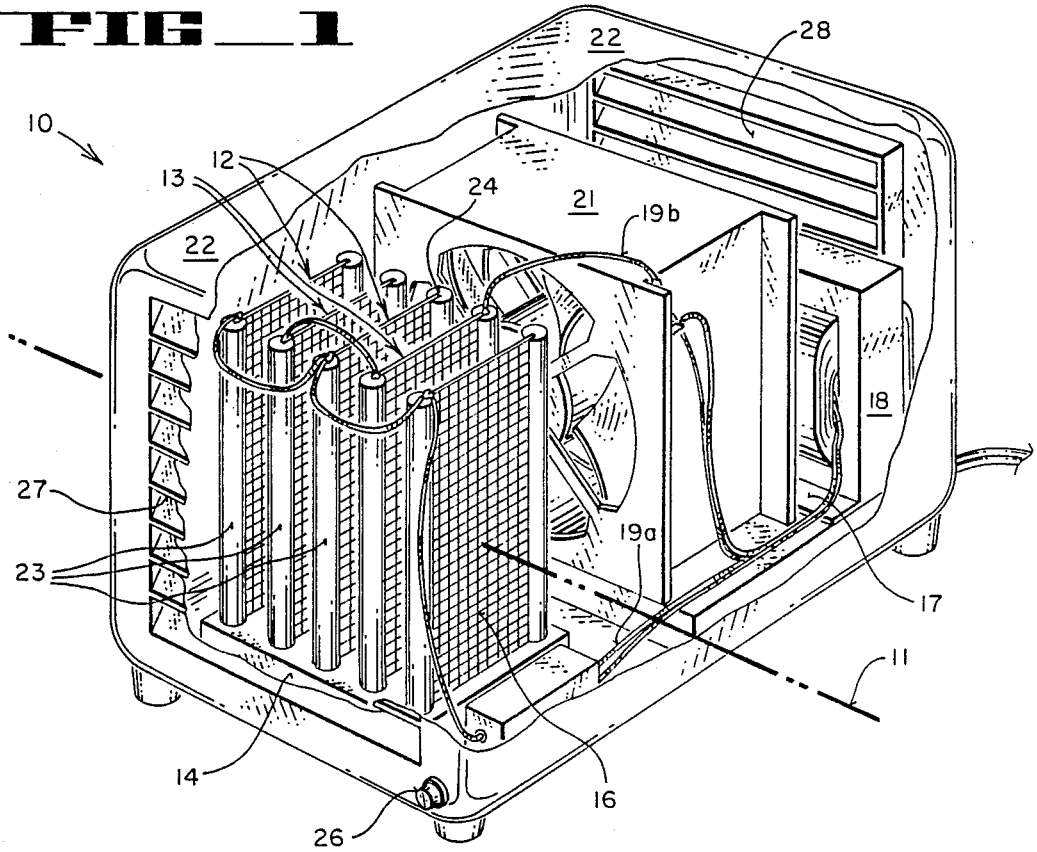
FIG. 1 shows a diagrammatic perspective view of a gas ionizing device with a large portion of the cover removed for clarity.

As shown best in FIGS. 1 through 4, a cross-field gas ionization system 10 includes means forming a dynamic population of electrons (sometimes referred to herein as a dynamic field of electrons) disposed to flow along a given axis 11. The foregoing means comprises a plurality of pervious grid assemblies 12, 13 disposed in parallel spaced relation. Grid assemblies 12 are connected to a high voltage dc positive or grounded electrode whereas grid assemblies 13 are negative with respect to assemblies 12. Accordingly, electrons flow from grid assemblies 13 to grid assemblies 12 to provide a dynamic flow of electrons therebetween. This flow of electrons passes along a given axis 11. All grid assemblies 12, 13 are supported upon an insulating base 14. Each grid assembly, 12,13, has been characterized by a pervious wire mesh screen 16. The roughness of the screen furnishes discharge points which provide for the field emission of the electrons.

System 10 includes a base 17 of substantially non-conductive material. Base 17 serves to support a transformer 18 connected by suitable leads 19*a*, 19*b* to supply the positive and negative grid assemblies 12, 13 respectively, with power on the order of 8,000–10,000 volts per inch.

The use of such a large electric field between the adjacent grids causes electrons to flow from one grid to the other to provide the dynamic population of electrons therebetween.

In addition to the above, base 17 supports an electric fan assembly 21 supplied with electricity.

System 10 further contains a cover or enclosure 22 therearound primarily for purposes of safety whereby small fingers will not be interposed between adjacent grid assemblies 12–13.

As noted above, each grid assembly 12, 13 is characterized by a pair of insulating supports 23 formed with elongate slots 24 therein. The slots 24 of each pair of insulating supports 23 are disposed in confronting relation and serve to receive a side edge of a pervious panel 16 of conductive mesh material therebetween.

An On-Off button 26 serves to turn the system on and off with successive depressions of the button. Accordingly, when the system is on, fan 21 will form a stream of gas directed crosswise of axis 11 to create a dynamic pneumatic flow of molecules (or field) to travel crosswise of the dynamic flow of electrons.

Figure 2:
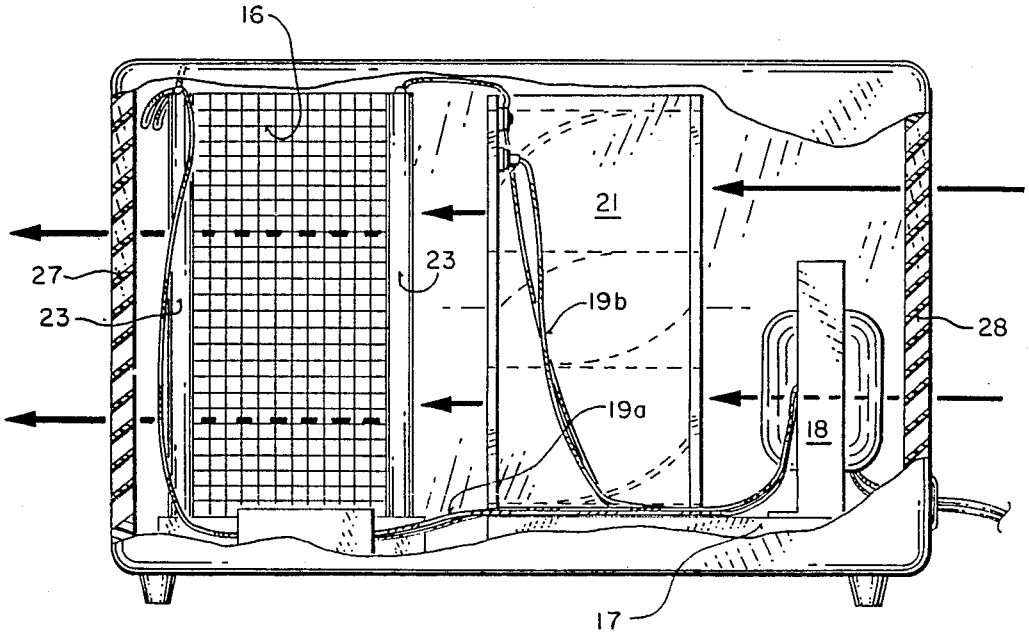
FIG. 2 shows a side elevation view with a portion of the unit removed according to FIG. 1.

The opposite ends of enclosure 22 are provided with openings, such as louvers 27,28 to permit environmental air to pass through fan 21 and the flow of electrons created between grid assemblies 12, 13. Thus, as shown in FIGS. 1 and 2, a stream of dynamic gas is directed crosswise of the given axis 11. The flow of electrons defined between adjacent grid assemblies 12, 13 has been created by an electric field which is sufficiently strong, on the order of 8,000–10,000 volts per inch, so as to retain all electrons therein other than those electrons which ionize molecules of the pneumatic field passing therebetween. By causing the gas to flow across and proximate the field of electrons, gas borne molecules will be ionized as they pass through the stream of electrons.

Accordingly, free electrons will not be discharged into the surrounding area whereby they would be directed to a wall surface or the like so as to attract positively charged molecules of particulate.

Accordingly, a gas ionization system has been provided of a type serving to minimize accumulation of particulate on the interior surfaces of a room. The system comprises briefly means forming a field of electrons disposed to flow along a given axis, and means forming a pneumatic flow directed across and through the field of electrons to ionize molecules of the pneumatic flow, the electric field that generates the stream of electrons is sufficiently strong so as to retain all electrons therein other than those electrons which ionize molecules of the pneumatic field.

Figure 5:
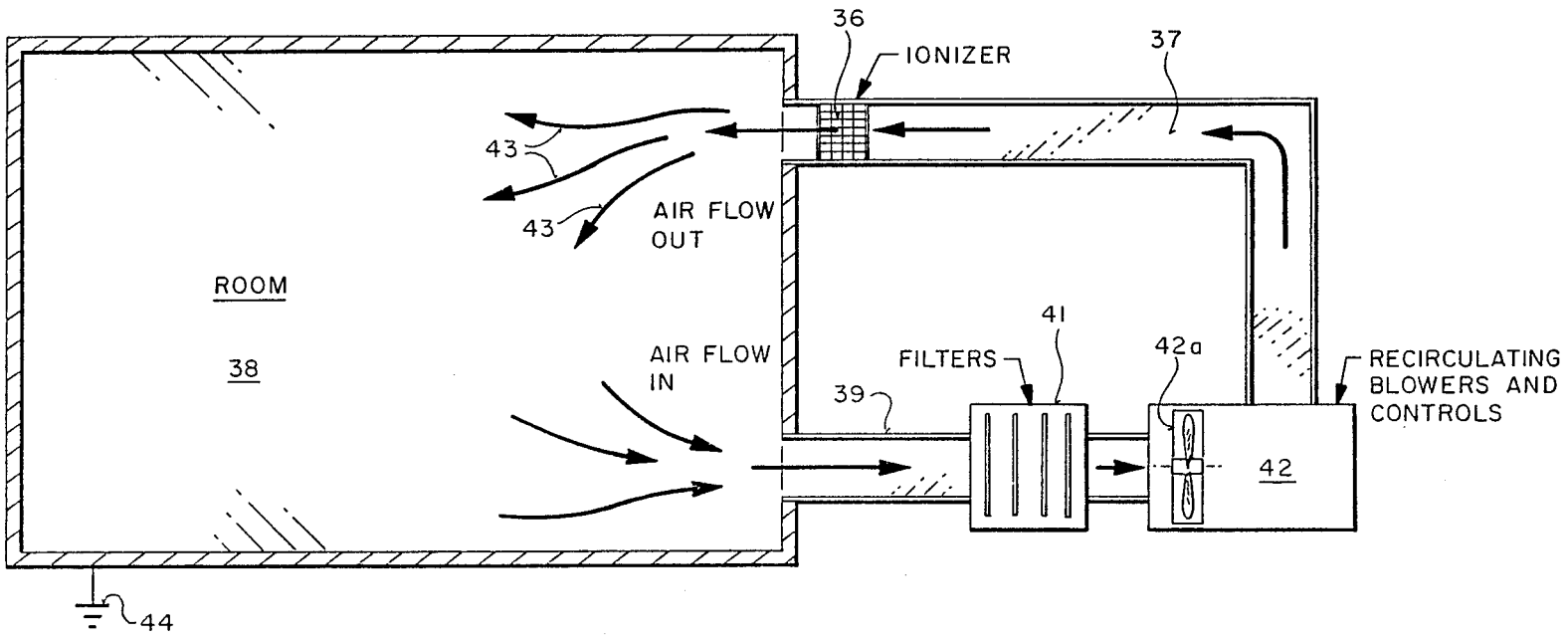
FIG. 5 shows a diagrammatic view of a system for using the unit in conjunction with an installed heating-/cooling system.

According to an application of the invention as shown in FIG. 5, an ionizing unit 36 has been disposed in the exhaust channel 37 of a recirculation system associated with a room 38. The intake channel 39 includes suitable filters 41 disposed upstream of a recirculating blower and controls 42. The blower portion **42*a* serves to create a dynamic pneumatic stream of gas to be discharged through ionizer 36**.

Accordingly, the discharging dynamic pneumatic field 43 will carry few, if any, free electrons with it.

Heretofore, air ionizers have discharged large numbers of high speed free electrons into the environment of a room or the like and these electrons tend to charge the walls in the room negatively. In the case where the high speed electrons charge the walls negatively, the walls become plated with particulate at an objectionably accelerated rate, on the order of months.

As described herein, the walls are usually nonconductive, therefore, they will assume a slight positive charge. This slight positive charge is derived from the triboelectric contact of the air with surfaces, such as the interior of conduit for an air circulation system. Since the floor of the room is normally at ground, as represented by the ground symbol 44, the walls being slightly positive, and since particulate in the air will normally be positive, some of the particulate will adhere to the wall to maintain this slight positive charge on the walls, since the wall will have a very small current drain therefrom. Therefore, the particulate that is free in the room next to the wall surfaces serves to maintain the positive charge on the wall. Therefore, the room will stay relatively clean for long periods of time. This phenomena manifests itself by the presence of a light shadow that exists when removing a picture which has hung on the wall for a long period of time, on the order of years.

I claim:

1. A method for ionizing a gas comprising the steps of:

providing at least a pair of spaced electrodes each formed of a wire screen in an enclosure, sustaining an electric field between the electrodes with the electrodes having discharge points for the field emission of electrons, the spacing between said electrodes and the magnitude of the electric field intensity being such that a number of free electrons are movable between the electrodes, directing a stream of gas in a direction substantially between the electrodes and substantially perpendicular to the direction of movement of the free electrons between the electrodes to ionize molecules of said gas stream, and maintaining the intensity of said electric field sufficiently high so that substantially all free electrons other than those electrons which ionize molecules of said gas stream are retained in the space between said electrodes.

2. A gas ionization system comprising:

means forming an enclosure, said enclosure having openings at opposite ends thereof to provide an inlet and outlet, respectively, means for directing a stream of gas through said enclosure, at least a pair of spaced, parallel electrodes each formed of a wire screen disposed within said enclosure, and electrical power means for applying positive and negative voltages, respectively, to said electrodes to generate an electric field therebetween, the electrodes being provided with discharge points for the field emission of electrons, the gas stream being movable between and from each of the electrodes, the spacing between said electrodes and the magnitude of the electric field intensity therebetween being such that a number of free electrons are movable between said electrodes with the free electrons disposed to flow between said electrodes in a direction substantially perpendicular to the direction of travel of said gas stream, the intensity of the electric field being sufficiently large so as to cause substantially all free electrons in said electric field other than those electrons which ionize molecules of said gas to be retained in the space between the electrodes.

* * * * *